US006088840A

United States Patent [19]

Im

[11] Patent Number: 6,088,840

[45] Date of Patent: Jul. 18, 2000

[54] BICOLOR REVERSIBLE SPARRING HEADGEAR

[76] Inventor: Sang Jun Im, 3903 Tedrich Blvd., Fairfax, Va. 22031

[21] Appl. No.: 09/240,678

[22] Filed: Feb. 2, 1999

[51] Int. Cl.[7] ..... A42B 3/00

[52] U.S. Cl. ..... 2/411; 2/425; 2/DIG. 2

[58] Field of Search ..... 2/410, 411, 417, 2/418, 419, 423, 425, DIG. 2, 171.03, 205, 195.1

[56] References Cited

U.S. PATENT DOCUMENTS

| | | | |
|---|---|---|---|
| Re. 35,193 | 4/1996 | Park | 2/195.2 |
| 1,111,659 | 9/1914 | Le Pierre . | |
| 1,538,847 | 5/1925 | Wheeler . | |
| 3,187,345 | 6/1965 | Holford | 2/209.1 |
| 4,222,122 | 9/1980 | Toms | 2/9 |
| 4,279,038 | 7/1981 | Bruckner et al. | 2/425 |
| 4,706,305 | 11/1987 | Cho | 2/425 |
| 4,716,599 | 1/1988 | Bell | 2/195 |
| 5,181,277 | 1/1993 | Sherman | 2/195 |
| 5,461,730 | 10/1995 | Carrington | 2/411 |
| 5,488,740 | 2/1996 | Garza | 2/175.1 |
| 5,515,546 | 5/1996 | Shifrin | 2/410 |
| 6,016,572 | 1/2000 | Park | 2/195.2 |

*Primary Examiner*—Michael A. Neas

[57] ABSTRACT

A bicolor reversible protective headgear comprising a left side panel, a right side panel, a forehead panel and a top panel, the panels being connected by elastic means to form the headgear and having a first color on one side and a second color on the other side, the headgear being reversible whereby the first color is visible when the headgear is in a first configuration and the second color is visible when the headgear is turned inside out to a second configuration.

17 Claims, 5 Drawing Sheets

BICOLOR REVERSIBLE SPARRING HEADGEAR

FIELD OF THE INVENTION

The present invention is directed to an improved headgear for martial arts contestants which is reversible so as to be wearable on both sides. The headgear comprises a plurality of protective foam panels assembled to form a head covering wherein the panels have a first color on one side and a second color on the other side whereby a competitor is provided with a comfortable and proper head protection regardless of the attitude of the headgear and may select one of the two colors simply by turning the headgear inside out. The construction of the headgear facilitates reversibility by means of elastic material which connects the panels at their adjacent edges to form the headgear.

BACKGROUND OF THE INVENTION

Since Taekwondo has become an advanced category for the year 2000 Olympic Games in Sydney, Australia, the number of Taekwondo practitioners has increased dramatically. To prevent injury, competitors are required to wear protective headgear. The headgear is provided in a single color. However, in order to make it easier to distinguish the competitors during a bout, competition directors have begun requiring competitors to wear different colored headgear. This requires that competitors carry at least two pieces of headgear to competitions, sometimes more, or to borrow headgear from other competitors. Often competitors do not know what color of headgear to wear until immediately prior to the competition. Accordingly, what is needed is a bicolor headgear that is reversible for use in either an obverse or reverse configuration, the obverse side being of one color and the reverse being of another color.

BACKGROUND OF PRIOR ART

Reversible head wear which has different colors or patterns on each side are known as shown by U.S. Pat. No. 1,111,659, LePierre, U.S. Pat. No. 1,538,847, Wheeler, U.S. Pat. No. 3,187,345, Holford and U.S. Pat. No. 5,181,277, Sherman. However, these hats do not provide the shock absorbent protection needed by competitors in martial arts and other sports.

Protective headgear for martial arts and other sports is commonly made from foam material covered by a pliable surface coating so as to be lightweight yet shock absorbent. The headgear are shaped to encompass the wearer's head and provide protection to all surfaces while permitting the wearer to see, breath and hear. Due to their vulnerability, extra protection is often provided over the ears. Examples of such prior art headgear are U.S. Pat. No. 4,222,122, Toms, U.S. Pat. No. 4,279,038, Bruckner, et al., and U.S. Pat. No. 4,706,305, Cho. Each of these types of headgear provide protection to the wearer's head but are useable in only one configuration.

The nature of the design and construction of the prior art headgear is such that they are formed so as to conform to the shape of the human head when in their correct, or right side out, configuration. When reversed, the headgear no longer conform to the cranial contours. Thus, they do not fit properly and are not useable in their intended manner. Although the materials from which they are made are resilient and flexible such that the prior art headgear are physically capable of being turned inside out, since no allowance is made to accommodate the stretching that occurs during reversal, those stresses tend to cause the materials to rupture and tear further rendering the prior art headgear unsuitable for reversible use.

SUMMARY OF THE INVENTION

The present invention provides a bicolor reversible protective headgear comprising a left side panel, a right side panel, a forehead panel and a top panel, the panels being connected by elastic means to form the headgear and having a first color on one side and a second color on the other side whereby the first color is visible when the headgear is in a first configuration and the second color is visible when the headgear is turned inside out to a second configuration.

The invention further provides a bicolor headgear wherein the left and right side panels are mirror images and each comprise a wide portion substantially covering the side of the head from the temples rearward and downward over the ears and cheeks and having openings over the ears to receive resilient ear pads; the top panel comprises an oval portion substantially covering the top of the head and narrowing as it extends downward over the back of the head between the left and right side panels, the upper edges of the left and right side panels being connected to opposite side peripheries of the top panel to form the headgear structure, and wherein the forehead panel is connected to and between the temple edges of the left and right side panels below the top panel to extend across a wearer's forehead.

The invention still further provides a bicolor reversible protective headgear comprising a left side panel, a right side panel, a forehead panel and a top panel, wherein the left and right side panels are mirror images and each comprise a wide portion substantially covering the side of the head from the temples rearward to the back of the head and from just below the crown of the head downward over the ears and cheeks and having openings over the ears to receive resilient ear pads, the left and right side panels including a narrow front strip joining the panels across the wearer's upper brow between the upper temples. The top panel comprises an oval portion substantially covering the top of the head between the left and right side panels and extending rearward from the narrow strip and narrowing and extending downward over the back of the head, the top panel being connected around its peripheral edge to upper edges of the left and right side panels and narrow front strip by elastic means. The forehead panel is connected by elastic means to and between the temple edges of the left and right side panels immediately below the narrow front strip to extend across the wearer's forehead and the panels comprise an energy absorbent, resilient foam material having a first color on one side and a second color on the other side whereby the headgear is reversible by turning inside out to expose the first color in a first configuration and the second color in a second configuration.

It is therefor an object of the present invention to provide a reversible protective headgear for martial arts and other sports.

It is a further object to provide a reversible protective headgear which has a first color on one side and a second color on the other side.

It is a still further object to provide a reversible protective headgear having stress relief means which stretch during reversal of the headgear and which allow the headgear to conform to the head in both the obverse and reverse configuration.

Further objects and advantages will become evident from the accompanying drawings and descriptions.

DETAILED DESCRIPTION OF THE INVENTION

Figure 1:
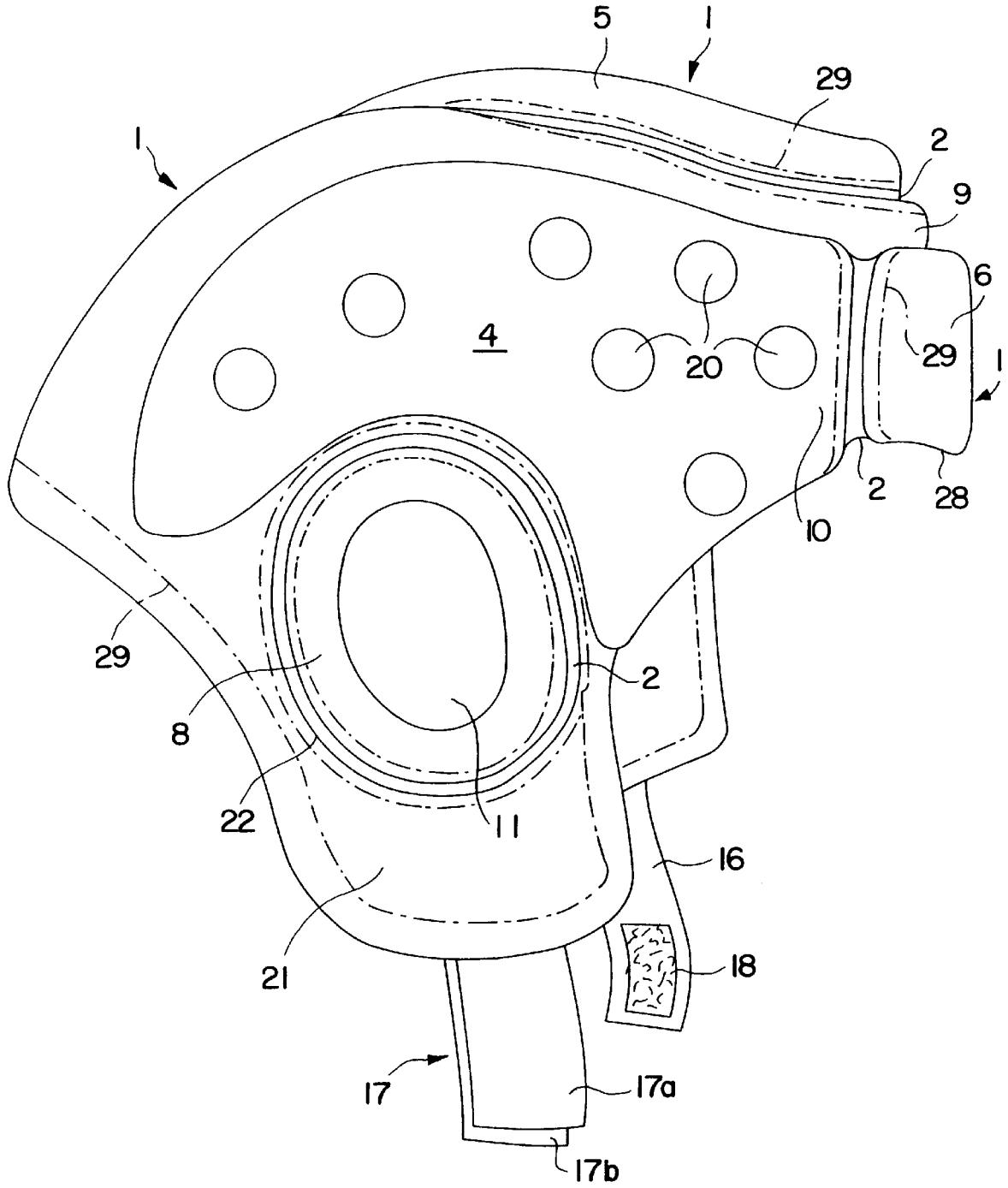
FIG. 1 is a side view of the reversible headgear of the present invention.

FIGS. 1–4 illustrate a preferred design for the headgear of the present invention which comprises a plurality of protective panels 1 which are connected by strips of elastic material 2 sewn or otherwise bonded to and between the panels 1. The shape of the panels 1 is such that, when connected by means of the elastic material 2, the headgear conforms to the head no matter which side is outermost.

The panels 1 are fabricated of a suitable material, conformable and resilient, as well as capable of absorbing energy when contacted and deformed by a blow. Preferred materials include elastomers such as closed cell polyurethane foam 25 or the like. The foam material is preferably provided with a surface coating 26 or casing which entirely covers the surface of the foam 25 and which may be colored or have color applied to it before drying. The coating 26 may be applied by painting, dipping, spraying or other means. A tough, rugged, pliable plastic such as polyvinyl chloride has been found to provide a suitable coating. Alternatively, the coating 26 may be a soft woven or nonwoven fabric which is applied and bonded to the foam 25, in which case, the fabric may be colored before or after application so as to provide the desired contrasting colors on each side of the headgear.

The panels are cut to shape while flat. Ventilation holes 20 are cut where desired and the coating 26 is applied. Each side of the panels 1 is coated with a different color and the panels 1 are assembled into the final headgear so that a first color is continuous on one side and a second color is continuous on the other side of the headgear.

The panels 1 of the headgear comprise a left side panel 3, a right side panel 4, a top panel 5 a forehead panel 6 and left and right ear pads 7 and 8. Left and right side panels 3 and 4 are shaped so as to cover the side of the head from just below the crown, downward over the temples, ears and cheeks. Rearwardly, left and right side panels 3 and 4 extend over the rear curvature of the head to the neck but do not meet. Openings 22 are provided in the cheek flaps 21 of the left and right side panels 3 and 4 over the ears to receive ear pads 7 and 8.

Figure 4:
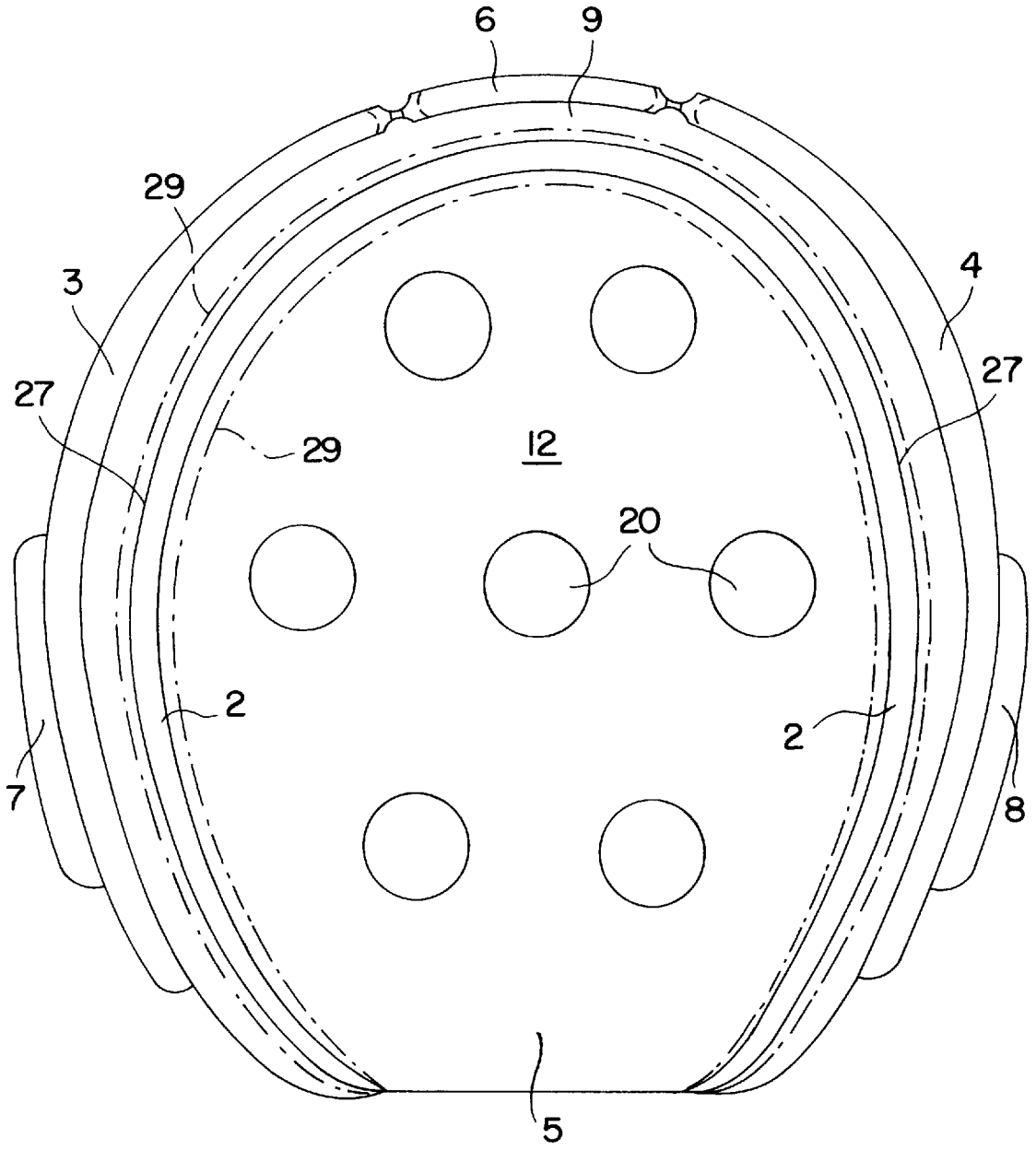
FIG. 4 is a top view of the reversible headgear of the present invention.

Although left and right side panels 3 and 4 may be completely separate elements, joined across the forehead by forehead panel 6, preferably left and right side panels 3 and 4 are cut as a single piece joined by a narrow front strip 9 of the foam material which will pass over the upper forehead above forehead panel 6 when the completed headgear is worn. This front strip 9 serves to better maintain the form of the headgear, whether in the obverse or reverse configuration since it provides a continuous edge 27 to panels 3 and 4 for connection to the top panel 5 as seen in FIG. 4.

Top panel 5 is positioned over the crown or top of the head from the upper edge of the forehead rearward and downward over the back of the head and spanning the space between the upper and rear edge 27 of left and right side panels 3 and 4. The shape of top panel 5 is somewhat akin to a bottle or vase and comprises a large oval portion 12 over the top of the head and narrows to a tail portion 13 as it passes downward over the back of the head. This "vase" shape of the top panel 5, together with the elastic material 2 joining the panels 1 together, provides the means whereby the headgear can conform to the shape of the head even when reversed without the need to separately mold the foam panels 1 to fit the three dimensional contours of the head. The shape of the top panel 5 dictates the curvature that the side panels 3 and 4 will take whether the headgear is in the obverse or reverse configuration and, since the top panel 5 narrows as it passes down the back of the head, the side panels 3 and 4 will naturally follow the side contours of the head.

Figure 2:
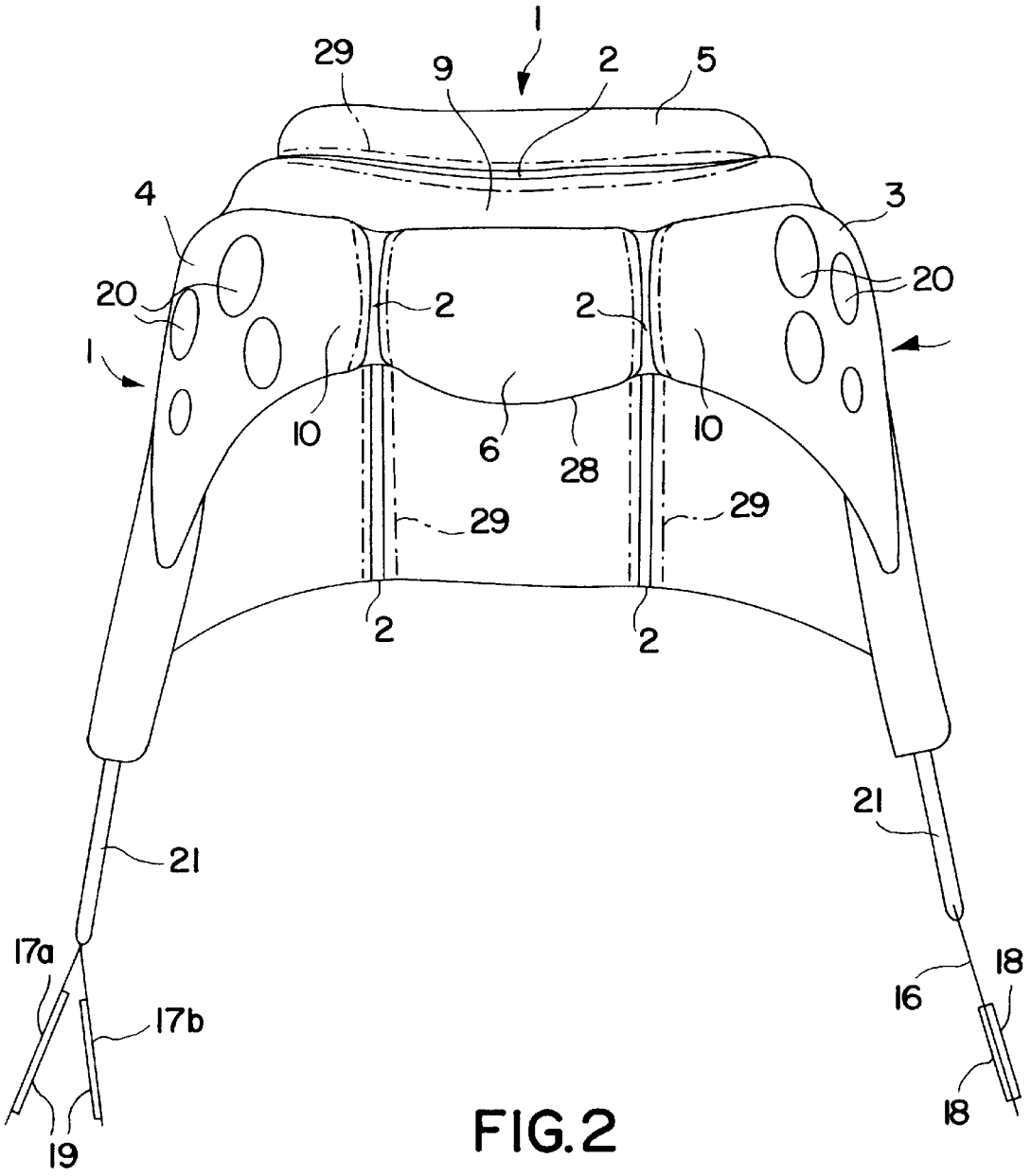
FIG. 2 is a front view of the reversible headgear of the present invention.
Figure 3:
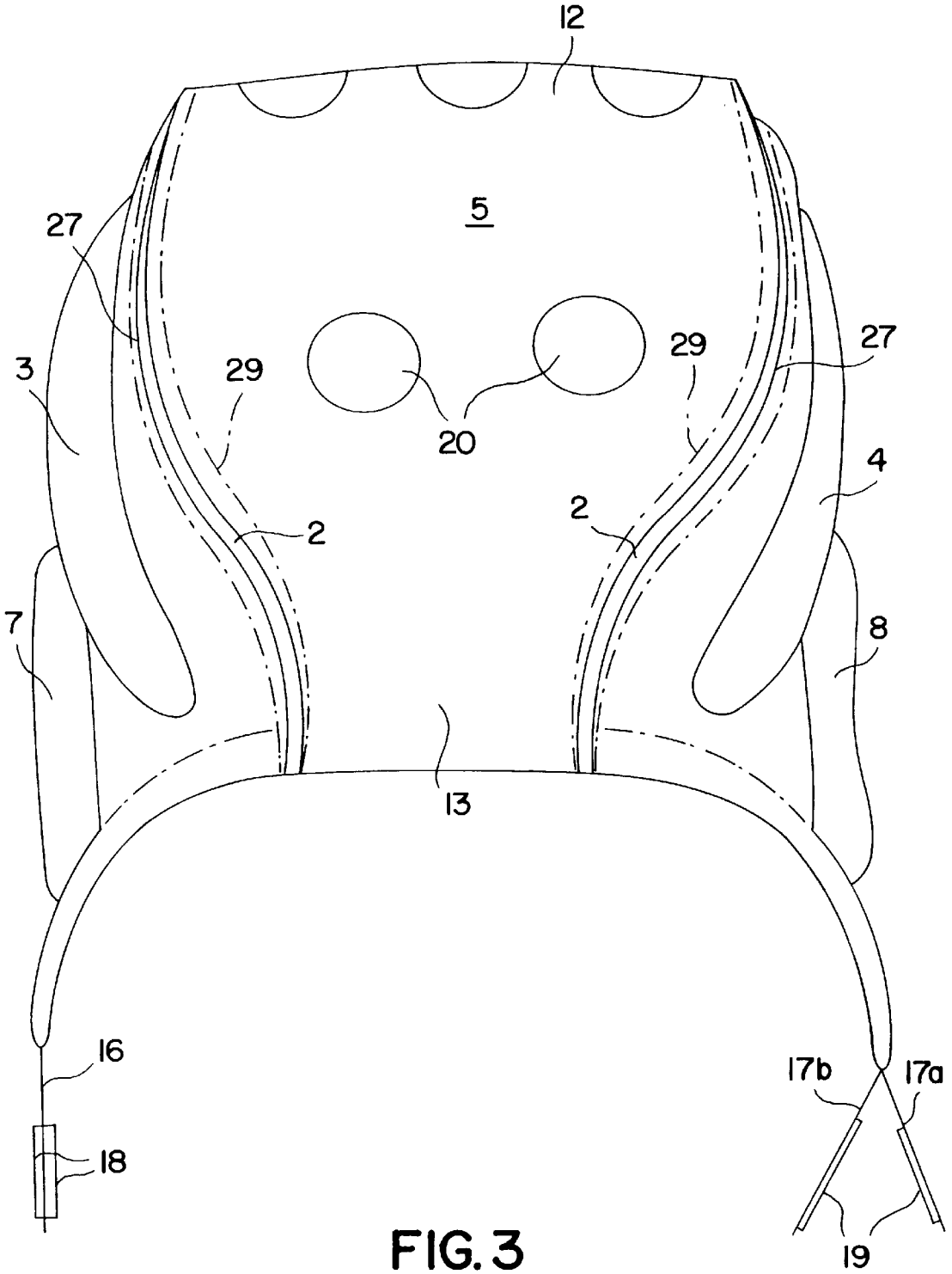
FIG. 3 is a rear view of the reversible headgear of the present invention.

Forehead panel 6 connects the temple portions 10 of left and right side panels 3 and 4 by means of the elastic material 2 and traverses the wearer's forehead. The lower edge 28 of forehead panel 6 is fashioned to follow the brow line of the face immediately above the eyes, as shown in FIG. 2, thus providing protection to the brow. The upper edge of forehead panel 6 is left free from attachment so that it may more easily pivot around narrow front strip when the headgear is turned inside out.

Left and right ear pads 7 and 8 are rings of coated foam material with a central aperture 11 to provide ventilation and pressure equalization over the ears. Pads 7 and 8 fit within the corresponding openings in the cheek flaps 21 of left and right side panels 3 and 4.

Figure 5:
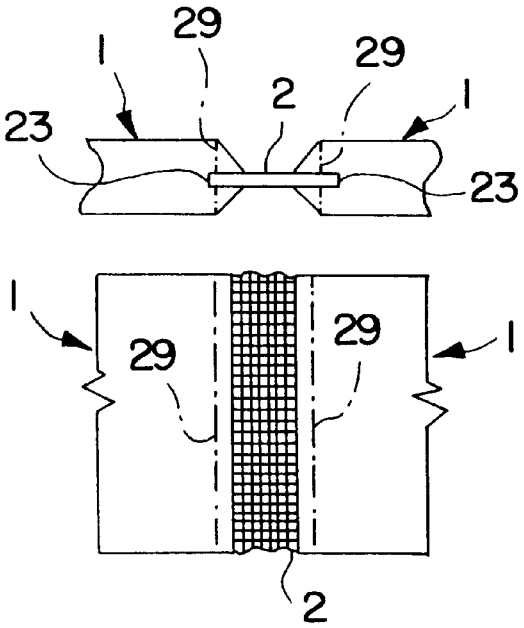
FIG. 5 is a detail of the assembly of elastic stress relief and protective panels of the headgear.

To allow the headgear to stretch when being reversed and thereby relieve the stress that would normally be applied to the foam and coating during that procedure, the panels 1 are joined by strips of elastic material 2 to form the headgear. Elastic material 2 is preferably a woven elastic material of medium weight and having elasticity at least across its width and preferably also along its length. To provide full usability of the headgear in the obverse and reverse configuration, the elastic material 2 is attached along adjoining panel edges halfway through the thickness of the foam as shown in FIG. 5. Preferably, this is accomplished by cutting or forming a slit along the edge of each panel into which the strip of elastic material 2 is inserted and secured either by stitching 29, heat sealing, adhesive bonding or other suitable means. Although illustrated as a complete web along each joined edge, it is within the scope of this invention to join the panels 1 by means of a plurality of individual elastic strips spaced along each joined edge.

Left and right ear pads 7 and 8 are secured within their respective apertures in the same manner using the elastic material 2. The elastic material 2 provides the ear pads with the flexibility to move inward and outward when the headgear is reversed, thereby increasing the comfort level and functionality of the headgear.

Figure 6:
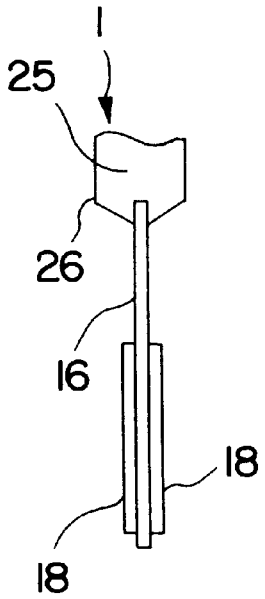
FIG. 6 is a detail of one end of the adjustable chin strap of the headgear.
Figure 7:
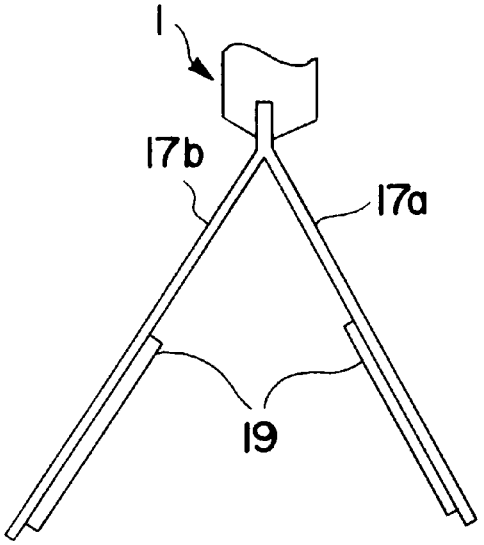
FIG. 7 is a detail of the other end of the adjustable chin strap of the headgear.
Figure 8:
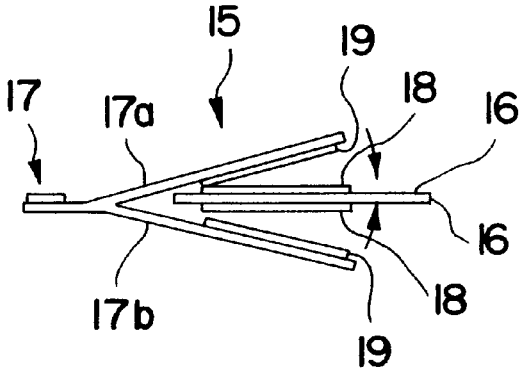
FIG. 8 is a detail showing how the ends of the chin strap connect.

Extending from the cheek flaps 21 of the headgear is a chin strap 15 which is designed to facilitate use in either the obverse or reverse configuration. As shown in FIGS. 6–8, the chin strap 15 comprises a first strap portion 16 secured to one cheek flap 21 in the same manner as the elastic material, and a second strap portion 17 similarly secured to the other cheek flap 21. First strap portion 16 is a single strap with one half of a hook and loop fastener 18 secured to both sides thereof. Second strap portion 17 consists of two straps 17*a* and 17*b* secured to the other cheek flap so as to be coextensive and to receive the first strap portion 16 therebetween. The facing surfaces of the two straps of the second strap portion 17 have the other half of the hook and loop fastener 18 secured thereto. To secure the chin strap 15 in either configuration of the headgear, the first strap portion 16 is placed between the two straps of the second strap portion 17 and the hook and loop fastener is engaged as shown in FIG. 8.

The foregoing construction provides a full coverage protective headgear having a first color on one side and a second color on the other side and which is fully reversible to expose either color to view by turning the headgear inside out. The reversibility of the headgear is facilitated by the use of elastic material to join the individual panels which make up the headgear and by the shape of the top panel which provides the headgear with the means to conform to the head regardless of the configuration. Furthermore, since the left and right ear pads 7 and 8 are also attached by the elastic material, they are freely adjustable to the wearer even when the headgear is turned inside out.

The above description and drawings illustrate the preferred embodiment of the present invention and it is understood that many variations and modifications will be evident to those skilled in the art and may be carried out without departing from the spirit and scope of the present invention.

What is claimed is:

1. A bicolor reversible protective headgear comprising a left side panel, a right side panel, a forehead panel and a top panel, the panels being connected by elastic means to form the headgear and having a first color on one side and a second color on the other side, the headgear being reversible whereby the first color is visible when the headgear is in a first configuration and the second color is visible when the headgear is turned inside out to a second configuration.

2. The headgear of claim 1 wherein the panels comprise an energy absorbent, resilient foam material having a colored surface.

3. The headgear of claim 2 wherein the left and right side panels are mirror images and each comprise a wide portion substantially covering the side of the head from the temples rearward and downward over the ears and cheeks and having openings over the ears to receive resilient ear pads, the top panel comprises an oval portion substantially covering the top of the head and narrowing as it extends downward over the back of the head between the left and right side panels, upper edges of the left and right side panels being connected to opposite side peripheries of the top panel to form the headgear structure, and wherein the forehead panel is connected to and between forward temple edges of the left and right side panels below the top panel to extend across a wearer's forehead.

4. The headgear of claim 3 wherein the panels are connected by elastic means secured within peripheral slits formed in the panel edges midway through the thickness of each panel.

5. The headgear of claim 4 wherein the elastic means is secured by stitching.

6. The headgear of claim 4 wherein the first and second colors are contrasting colors.

7. The headgear of claim 4 wherein the first and second colors are applied as a pliable coating over the foam.

8. The headgear of claim 4 further comprising a separable and adjustable chin strap attached to lower edges of the left and right side panels.

9. The headgear of claim 8 wherein the chin strap comprises a first strap member extending from one of the left and right side panels and having a first half of a pressure sensitive fastening means on both sides thereof, and a second strap member comprising a pair of coextensive straps extending from the other of the left and right side panels and having the second half of the pressure sensitive fastening means on the facing sides thereof, whereby the first strap member is positionable between the coextensive straps of the second strap member and the first and second halves of the pressure sensitive fastening means engage to secure the chin strap.

10. A bicolor reversible protective headgear comprising a left side panel, a right side panel, a forehead panel and a top panel, wherein the left and right side panels are mirror images and each comprise a wide portion substantially covering the side of the head from the temples rearward to the back of the head and from just below the crown of the head downward over the ears and cheeks and having openings over the ears to receive resilient ear pads, the left and right side panels including a narrow front strip joining the panels across the wearer's upper brow between the upper temples;

the top panel comprises an oval portion substantially covering the top of the head between the left and right side panels and extending rearward from the narrow strip and narrowing and extending downward over the back of the head, the top panel being connected around its peripheral edge to upper edges of the left and right side panels and narrow front strip by elastic means;

the forehead panel being connected by elastic means to and between front temple edges of the left and right side panels immediately below the narrow front strip to extend across the wearer's forehead;

and wherein the panels comprise an energy absorbent, resilient foam material having a first color on one side and a second color on the other side whereby the headgear is reversible by turning inside out to expose the first color in a first configuration and the second color in a second configuration.

11. The headgear of claim 10 wherein the panels are connected by elastic means secured within peripheral slits formed in the panel edges midway through the thickness of each panel.

12. The headgear of claim 11 wherein the elastic means is secured by stitching.

13. The headgear of claim 10 wherein the first and second colors are contrasting colors.

14. The headgear of claim 13 wherein the first and second colors are applied as a pliable coating over the foam.

15. The headgear of claim 11 further comprising a separable and adjustable chin strap attached to lower edges of the left and right side panels.

16. The headgear of claim 15 wherein the chin strap comprises a first strap member extending from one of the left and right side panels and having a first half of a pressure sensitive fastening means on both sides thereof, and a second strap member comprising a pair of coextensive straps extending from the other of the left and right side panels and having the second half of the pressure sensitive fastening means on the facing sides thereof, whereby the first strap member is positionable between the coextensive straps of the second strap member and the first and second halves of the pressure sensitive fastening means engage to secure the chin strap.

17. The headgear of claim 16 further comprising left and right protective ear pads having pressure equalization openings therein and being separately mounted within apertures in left and right side panels by the elastic means, whereby the ear pads are laterally adjustable relative to the left and right side panels to provide comfortable fit and protection when the headgear is in the first and second configurations.

* * * * *